US009352368B2

(12) United States Patent
Colombo

(10) Patent No.: US 9,352,368 B2
(45) Date of Patent: May 31, 2016

(54) METHOD AND PLANT FOR PRODUCING METAL ROLLED PRODUCTS

(75) Inventor: Ezio Colombo, Milan (IT)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 14/236,673

(22) PCT Filed: Jul. 20, 2012

(86) PCT No.: PCT/EP2012/064326

§ 371 (c)(1),
(2), (4) Date: Mar. 7, 2014

(87) PCT Pub. No.: WO2013/017444

PCT Pub. Date: Feb. 7, 2013

(65) Prior Publication Data

US 2014/0182345 A1 Jul. 3, 2014

(30) Foreign Application Priority Data

Aug. 1, 2011 (EP) ..... 11006314

(51) Int. Cl.

| | |
|---|---|
| ***B21B 1/46*** | (2006.01) |
| ***B21B 1/18*** | (2006.01) |
| ***B21B 1/16*** | (2006.01) |
| ***B21B 27/03*** | (2006.01) |

(52) U.S. Cl.

CPC . *B21B 1/463* (2013.01); *B21B 1/18* (2013.01); *B21B 1/163* (2013.01); *B21B 27/035* (2013.01)

(58) Field of Classification Search

CPC ..... B21B 1/46; B21B 1/466; B21B 1/18; B21B 1/34; B21B 2275/06; B21B 1/04; B21B 37/46

See application file for complete search history.

(56) References Cited

U.S. PATENT DOCUMENTS

| | | | | |
|---|---|---|---|---|
| 4,149,583 | A * | 4/1979 | Tsuchida | B22D 11/147 164/416 |
| 4,457,154 | A * | 7/1984 | Ohba | B21B 37/52 72/12.8 |
| 5,123,007 | A | 6/1992 | Miyauchi et al. | |
| 5,404,931 | A * | 4/1995 | Anzai | B21B 1/463 164/417 |
| 5,548,986 | A * | 8/1996 | Matsuo | B21B 1/0815 72/204 |
| 6,763,561 | B2 * | 7/2004 | Sclippa | B21B 1/18 29/33 C |

FOREIGN PATENT DOCUMENTS

| | | | |
|---|---|---|---|
| DE | 3816469 | A1 | 11/1989 |
| EP | 0243976 | A2 | 11/1987 |
| JP | 55112105 | | 8/1980 |
| JP | S5731402 | A | 2/1982 |
| JP | S6313785 | A | 1/1988 |
| JP | 04258348 | | 9/1992 |

* cited by examiner

*Primary Examiner* — Peter DungBa Vo
*Assistant Examiner* — John S Lowe
(74) *Attorney, Agent, or Firm* — Laurence A. Greenberg; Werner H. Stemer; Ralph E. Locher

(57) ABSTRACT

A method for producing rolled products includes providing two parallel lines downstream of a continuous casting, for conveying profiled supply sections that converge together at least at a single first rolling station. A plant for implementing the method is also provided.

3 Claims, 1 Drawing Sheet

METHOD AND PLANT FOR PRODUCING METAL ROLLED PRODUCTS

BACKGROUND OF THE INVENTION

Field of the Invention

The present invention refers to an apparatus for producing long metal rolled products (for example section bars, rods for reinforced concrete and the like), which are preferably made of steel.

These products are normally made from metal raw materials and/or scrap that are conveyed to a furnace that transform the raw materials and/or scrap into a liquid state to then produce, according to the principles of so-called "continuous casting", supply section bars of the required dimensions (normally billets, but also blooms or flat blooms).

The supply section bars are then cut, cooled and lastly conveyed to a rolling mill where they undergo a variation in size and/or shape in such a manner as to be used in the different applications of the engineering industry.

There currently exist solutions that connect continuous casting directly to the rolling mill in order to reduce plant running costs.

These solutions envisage a single casting line that enters the rolling mill directly.

Nevertheless, the maximum productivity of a rolling mill is normally much greater than that of continuous casting, with the result that such apparatuses do not have the best results in terms of productivity: continuous casting, in fact, does not succeed in reaching speeds that are sufficient for saturating the productive capacity of a rolling mill, with the result that the rolling mill is underused.

A first known solution is that of increasing casting speed: the advantages arising from this solution are nevertheless very limited because above certain speed values the quality of the material produced deteriorates drastically.

Another known feature is that of increasing the dimension of the section of the supplied cast section bar: this entails, however, an increase in the number of rolling cages in the rolling mill with a consequent increase in plant costs that is not justified by the production increase obtained; further, this entails greater mechanical stress to which the material is subjected.

Still another solution is the one disclosed in document EP 1187686: from continuous casting, a main supply line to the rolling mill exits as well as one or more parallel auxiliary lines from which the supply section bars are transferred to the main line to be able to be thus worked; basically, these auxiliary lines act merely as a "storage" units for supplying the rolling mill.

A first drawback of this solution relates to the fact that for the transit from an auxiliary line to the main line it is necessary to set up transfer rollers and that the control of the transfer speeds of the supply section bars (unlike for the main line and the auxiliary line) has to be particularly attentive to enable the rolling mill to be supplied regularly.

BRIEF SUMMARY OF THE INVENTION

The object of this invention is to overcome these drawbacks.

Said object is achieved by a method and a plant according to the attached claims, which method and plant are intended to be an integral part of the present description.

In brief, the applicant has cast simultaneously, by continuous casting, several supply section bars, preferably two, that may be flat blooms, blooms, billets or the like, according to a preferred embodiment billets (for example, with a section of 100×100 mm or 130×130 mm), with the same section, and has rolled them simultaneously.

In this manner, advantageously, casting can be at normally used speeds, without introducing variants and unknown factors into the productive process, thus obtaining, however, a doubling of productivity compared with a single-line process and without having to necessarily increase the number of rolling cages. Although the process according to the invention allows higher casting speeds if desired, one advantage is the possibility of obtaining high productivity even with speeds below 5-6 m/s.

The structural and functional features of the invention and the advantages thereof over the prior art will be clearly understandable from the following description referring to the attached drawings, which show, purely by way of non-limiting example of the protective scope of the present application, a possible embodiment of the invention.

DESCRIPTION OF THE INVENTION

Figure 1:
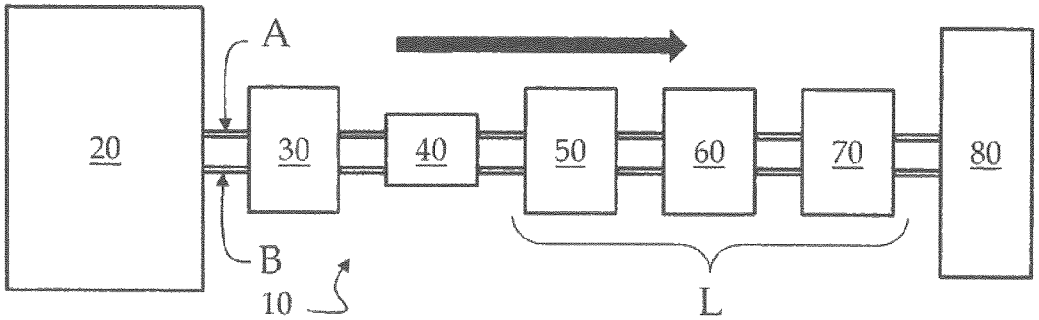
FIG. 1 is a flow chart of a first embodiment of the invention.

With reference to FIG. 1, a first simplified embodiment of the present invention is noted therein.

In this figure, overall with reference 10 a plant is indicated for producing rolled products according to the present invention.

The plant 10 comprises means for continuous casting 20 that are suitable for making two or more supply section bars (of the type indicated above), by means of a corresponding number of casting moulds with all the necessary devices and accessories; from such means, the supply section bars emerge, which travel from continuous casting 20 to the cooling/evacuation appliance 80, passing through at least one rolling mill L: the flow direction is indicated in the figure by an arrow for greater ease of understanding.

The means for continuous casting 20 are located downstream of a source of molten metal, which may comprise a furnace of known type, for example electric (such as an EAF or an induction arc or ladle or other furnace) that is supplied with raw materials and/or scrap that are melted and thus produce the continuously cast supply section bars. If appropriate, other known structures may be present such as tundishes, ladles, one or more supply lines of raw materials, of per se known type, and which will not be discussed further.

According to an embodiment of the present invention, from continuous casting means 20, two parallel lines A and B exit that are suitable for translating and/or dragging, at a suitable advancing speed, the supply section bars that travel along the lines A and B.

Figure 2:
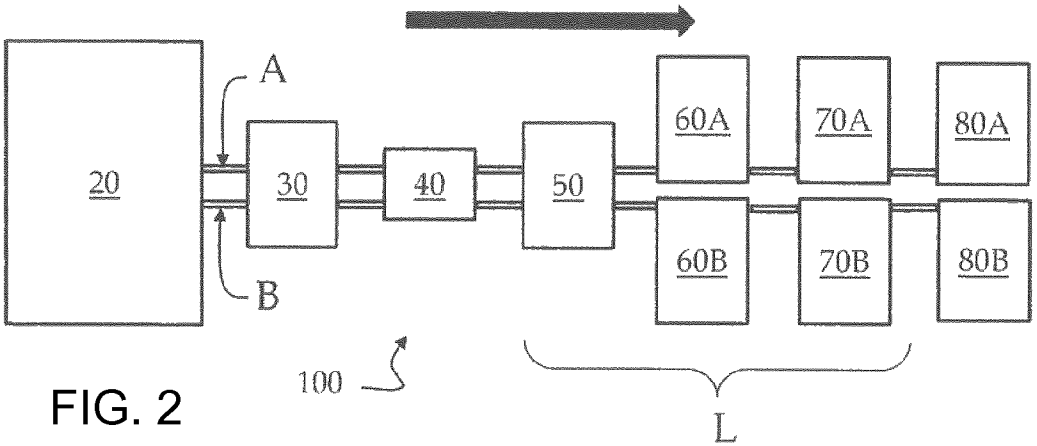
FIG. 2 is a flow chart of a second embodiment of the invention.

The lines A and B can comprise driven roller and/or idle roller conveying means or the like, of the type normally used in such types of plant: lines A and B are thus true conveying means and have, according to a preferred embodiment, a substantially parallel pattern over the entire extent thereof in the plant that is indicated with the references 10 and 100 in FIGS. 1 and 2 respectively.

It should be noted that the advancing speed along the lines A and B depends to a large extent on casting speed: more in particular, in order to have the same speed on both lines, there must be the same casting speed for the section bars that travel along line A and line B; this implies careful control of this speed such that it is the same for both lines A and B.

In this manner, the supply section bars, for example billets, on both lines A and B, travel at the same speed, provided that the driven rollers of lines A and B are also maintained at the same rotation speed.

The supply section bars exiting continuous casting 20 can be supplied to a cutting apparatus 30 that is per se of known type, which performs the cut, where necessary, for example during the test-piece production steps, in the event of malfunctions in any part of the plant, during the startup or stop steps or for any particular machining that requires cutting.

In this description and in the following claims, the term "supply section bar" is used to indicate, depending on the case, both the not yet cut section bar (the section bar between the continuous casting 20 means and the cutting apparatus 30), and the section bar that may have been cut transversely and which has already undergone one or more rolling passes, both in the form of billets or some other form.

Going back to the example, in FIG. 1, it should be noted that there may preferably be a single cutting apparatus 30 that is common to both lines A and B, such as to cut the supply section bar of both the lines A and B evenly (i.e. at corresponding points on both lines A and B).

The cutting apparatus 30 is per se of known type and is usually used in such types of plant and will not therefore be discussed any more.

Preferably, the section bar is supplied to the cutting apparatus 30 in such a manner that the same cutting blade of the latter acts simultaneously on both the section bars of lines A and B.

For this purpose, both lines A and B converge in the same and single cutting space in which the cutting blade is operational.

Downstream of the cutting apparatus 30, the section bars of the lines A and B, which have already been cut, are sent, according to a particular embodiment of the invention, to heating means 40, like an induction, gas or similar furnace, that is useful for making even the temperature of the section bars that traverse the furnace.

Also in this case it should be noted how the heating means 40 are preferably common to both lines A and B, in such a manner as to ensure that the supply section bars are taken to the same temperature: advancing speed being the same as for lines A and B, the transit in the same chamber of the furnace (thus at the same temperature), indirectly ensures that the same amount of heat is administered to the section bars of line A and to the section bars of line B, without complex checks being necessary for this test.

Similarly to what is set out above, in this case the two lines A and B both converge in the same chamber as the heating means 40.

Downstream of the heating means 40, the section bars of both lines A and B together reach a first station 50 of the rolling mill, which is overall indicated by letter L.

The first station 50 of the rolling mill L is, according to a preferred embodiment of the invention, a so-called "roughing station": roughing is the first rolling operation that occurs at low speeds with a series of cages, normally with rollers, usually made of cast iron, that permit a first reduction of the section of the section bar.

The station 50 thus comprises at least one, preferably a plurality of cages provided with rolling rollers.

It should be noted that according to the teachings of the present invention, both the section bars of the lines A and B are worked simultaneously and by the same rollers of the same cages of the roughing station 50.

The roughing station 50 is preferably a horizontal roughing station.

Similarly to what was written above, the lines A and B both converge in the same processing space comprised between opposite rollers of the same cage, in such a manner that the section bars are worked by the same rollers of the same cage.

Downstream of the roughing station 50, in the embodiment in FIG. 1, the rolling mill L comprises two successive stations 60 and 70, respectively a so-called "intermediate" processing station 60 and a finishing station 70.

Also in the latter, both the section bars of lines A and B are worked simultaneously and by the same rollers of the same cages of the stations 60 and 70.

As the speed of a section bar increases proportionally with the decrease in the section resulting from rolling of the section bar (through the principle of conservation of mass), by using the same stations 50,60,70 to work simultaneously the same section bars of the two lines A and B, the speed and flow of the section bars is regulated substantially "automatically".

In fact, as the station 50 receives the section bars from the lines A and B at the same moment, it accelerates the section bars equally until they are both taken to the same output speed, without any additional control or action being necessary.

In this manner, the section bars that have already been rough-shaped, exiting the station 50 along lines A and B, will simultaneously reach the station 60, from where (through the effect of the rolling simultaneously and under the same rollers of the same cages) they will exit simultaneously and at the same speed, directed to the next station 70.

Similarly, also in this finishing station, the section bars of the lines A and B, which have simultaneously reached and been simultaneously worked by the same rollers of the same cages, will exit simultaneously and at the same speed, directed towards a final cooling and evacuation station 80, this station also being common to both the lines A and B.

In this manner, all the stations 50,60,70 downstream of continuous casting are supplied simultaneously with section bars having the same speed and that travel along the lines A and B, so as to say, always "paired".

In other words, the method that is at the basis of the present invention ensures that in at least one of the processing stations of the rolling mill (preferably the first, or roughing station 50), the supply section bars conveyed by the two lines A and B undergo rolling simultaneously and by the same rollers of the same rolling cages.

The method that is the object of the present invention is fully understandable from the description supplied so far.

Nevertheless, purely for reasons of completeness, the steps are disclosed below of the method for producing rolled products, according to the present invention, that comprises the steps of:

a) generating together, simultaneously and at the same speed, at least two supply metal section bars by a single continuous casting process, b) sending together said two supply metal section bars simultaneously and at the same speed to at least a first rolling station 50 of a rolling mill L, said first rolling station 50 comprising at least one cage provided with rolling rollers, c) rolling together said two supply metal section bars simultaneously and with the same rollers of the same rolling cage of said first rolling station 50.

Further, going into greater detail, the method further comprises the steps of:

d) sending together said two metal section bars exiting said first rolling station 50 simultaneously and at the same speed to a second rolling station 60 that comprises at least one cage provided with rolling rollers, e) rolling together said two section bars of the preceding step simultaneously and with the same rollers of the same rolling cage of said second rolling station 60, f) sending said two metal section bars exiting said second rolling station 60 simultaneously and at the same speed to a third rolling station 70 that comprises at least one cage provided with rolling rollers, e) rolling together said two section bars of the preceding step simultaneously and with the same rollers of the same rolling cage of said third rolling station 60.

One variant of the first embodiment of the plant and of the corresponding processing method disclosed until now is shown in FIG. 2, in which the same parts are referred to with the same reference numbers and they will not be discussed any further.

The plant is indicated overall here by 100, and the difference in this case consists of the fact that downstream of the roughing station 50, the two lines A and B follow different paths: line A in fact reaches an intermediate rolling station 60A from which it exits to reach the finishing station 70A and then reach a cooling and evacuation station 80A.

Similarly, line B, downstream of the roughing station 50, reaches an intermediate rolling station 60B from which it exits to reach the finishing station 70B, to then reach a cooling and evacuation station 80B.

The advantages are substantially those listed above, with in addition the possibility of performing intermediate processing and different finishing for each line A, B. Further, both in the case of different processes and similar processes on the two lines it will thus be possible to use cages with the rollers arranged at angles that are different from those of the rollers of the first station 50 that is common to the two lines, for example, vertical-axis rollers can be used that in the rolling plants commonly alternate with horizontal-axis rolling plants.

Again for the sake of completeness, the implemented method is disclosed here briefly: steps a)-c) disclosed above remain the same, whereas steps d)-e) are replaced by the following:

d') sending separately said two metal section bars exiting said first rolling station 50 to two different second rolling stations 60A,60B e') rolling separately said two section bars of the preceding step f') sending separately said two metal section bars exiting said second rolling station 60 to respective third rolling stations 70 e') rolling separately said two section bars of the preceding step.

It should be noted that in general a minimum distance should be maintained between the continuous casting moulds, for correct operation thereof, a distance that may in general be greater than what would be desirable between the section bars in the rolling stations that are common to two or more lines, in which an excessive distance would entail structures with dimensions that are increased unnecessarily. Merely by way of example, the distance between the section bars exiting the casting moulds could be about 900-1000 mm, whereas the desirable distance in the common rolling station could be around 500 mm.

For this reason, bars deviating and straightening means can be provided, to bring the supply section bars close upstream of the first rolling station. Such means can, for example, comprise vertical-axis rollers, guides and/or other devices that are deemed to be suitable.

According to a preferred embodiment, they can be placed downstream of the heating means 40, in particular if the heating means are of the induction type, in which the distance between the section bars can be advantageous for structural reasons. Further, in this manner, the section bars are subjected to the mechanical stress of straightening after the temperature has been made appropriately uniform inside the section thereof.

The objects mentioned in the preamble of the description have thus been achieved.

Numerous variants on the method and on the plant that has been disclosed so far are thus possible, for example, processing stations can be introduced in positions that are intermediate or downstream of those disclosed, without thereby falling outside the scope of the present invention.

The scope of the invention is defined by the following claims.

The invention claimed is:

1. A method for producing rolled products, the method comprising the following steps:

a) generating together, simultaneously and at an identical speed, at least two supply metal section bars by a continuous casting process;

b) sending together the two supply metal section bars simultaneously and at an identical speed to at least a first rolling station of a rolling mill, the first station including at least one cage provided with rolling rollers;

c) rolling together the two supply metal section bars simultaneously and with identical rollers of an identical rolling cage of the first rolling station;

d) sending together the two metal section bars exiting the first rolling station simultaneously and at an identical speed to a second rolling station including at least one cage provided with rolling rollers;

e) rolling together the two section bars of step d) simultaneously and with an identical rolling cage of the second rolling station;

f) sending the two metal section bars exiting the second rolling station simultaneously and at an identical speed to a third rolling station including at least one rolling cage provided with rolling rollers; and g) rolling together the two section bars of step f) simultaneously and with identical rollers of an identical rolling cage of the third rolling station.

2. The method according to claim 1, which further comprises providing the first rolling station as a roughing station with horizontal axis rollers.

3. The method according to claim 1, wherein, in the generating step, the at least two supply metal section bars are generated with identical cross sectional areas.

* * * * *